US008970399B1

(12) United States Patent
Zimmer et al.

(10) Patent No.: US 8,970,399 B1
(45) Date of Patent: Mar. 3, 2015

(54) SELECTIVE NOTAM NOTIFICATION

(75) Inventors: Nico Zimmer, Kenn (DE); Keyvan Bayram, Frankfurt (DE)

(73) Assignee: The Boeing Company, Chicago, IL (US)

( * ) Notice: Subject to any disclaimer, the term of this patent is extended or adjusted under 35 U.S.C. 154(b) by 816 days.

(21) Appl. No.: 12/871,412

(22) Filed: Aug. 30, 2010

(51) Int. Cl.
*G08B 21/00* (2006.01)

(52) U.S. Cl.
USPC ..... 340/945; 701/9; 701/16; 701/301

(58) Field of Classification Search
CPC ..... B64D 45/0015; B64D 2045/0045; G01C 23/00; G08G 5/0013; G08G 5/0021; G08G 5/0034; G08G 5/0091; G08G 5/065; G06Q 10/06
USPC ..... 340/945; 701/14, 32.3, 32.4, 423, 701/428–429
See application file for complete search history.

(56) References Cited

U.S. PATENT DOCUMENTS

| | | | | |
|---|---|---|---|---|
| 4,425,617 | A * | 1/1984 | Sherwood | 710/65 |
| 5,208,590 | A * | 5/1993 | Pitts | 340/973 |
| 6,199,008 | B1 | 3/2001 | Aratow et al. | |
| 6,700,482 | B2 * | 3/2004 | Ervers et al. | 340/500 |
| 7,081,834 | B2 * | 7/2006 | Ruokangas et al. | 340/945 |
| 7,813,871 | B2 * | 10/2010 | Small et al. | 701/120 |
| 8,046,165 | B2 * | 10/2011 | Sacle et al. | 701/33.4 |
| 8,200,378 | B1 * | 6/2012 | Chiew et al. | 701/4 |
| 8,203,465 | B2 * | 6/2012 | Shafaat et al. | 340/971 |
| 8,332,084 | B1 * | 12/2012 | Bailey et al. | 701/10 |
| 2003/0225489 | A1 * | 12/2003 | Tsao | 701/9 |
| 2006/0129286 | A1 | 6/2006 | King | |
| 2008/0198157 | A1 * | 8/2008 | Feyereisen et al. | 345/419 |
| 2009/0093953 | A1 * | 4/2009 | Wiesemann et al. | 701/200 |
| 2011/0264313 | A1 * | 10/2011 | Sampath | 701/16 |
| 2012/0274484 | A1 * | 11/2012 | Zimmer et al. | 340/945 |

OTHER PUBLICATIONS

Defense Internet NOTAM Service, "NOTAM Retrieval" https://www.notams.jcs.mil/dinsQueryWeb/ [retrieved Jan. 14, 2010], 2 pages.
Hatta, Takashi, "Current activity towards digital AIM in Japan," 5th Digital NOTAM Workshop, Eurocontrol, 10 pages, Sep. 2009.
Vernaleken, et al., "Considerations on Symbology, Data Requirements, and Operational Concept for integral NOTAM Visualization on Airport Moving Map Displays," Proceedings of SPIE vol. 6957, Enhanced and Synthetic Vision 2008, 16 pages, Apr. 2008.
Final Office Action in U.S. Appl. No. 12/689,600 dated Jun. 22, 2012.
Non-Final Office Action in U.S. Appl. No. 12/689,600 dated Jan. 6, 2012.
Non-Final Office Action in U.S. Appl. No. 13/249,721 dated Apr. 4, 2013.
Notice of Allowance dated Oct. 21, 2013 in U.S. Appl. No. 13/249,721.

* cited by examiner

*Primary Examiner* — Omer S Khan
(74) *Attorney, Agent, or Firm* — Hope Baldauff, LLC

(57) ABSTRACT

Methods, systems, and computer-readable storage media provide for selective Notice to Airmen (NOTAM) notifications to be made to the crew of an aircraft according to the relevance of the NOTAM to a selected phase of flight of the aircraft. According to embodiments described herein, NOTAMs are received and parsed for subject and status codes. The subject and status codes are used with the selected phase of flight to determine a relevance code each NOTAM according to a set of relevance rules. The relevance rules provide a level of relevance of the NOTAM to the phase of flight and trigger a type of notification according to that level of relevance.

17 Claims, 5 Drawing Sheets

208

| NOTAM SUBJECT | | 204 | | | | | | | | | | | | | | | |
|---|---|---|---|---|---|---|---|---|---|---|---|---|---|---|---|---|---|
| 307 LIGHTING FACILITIES (L) | | PLN | PRE FLT | ENG STRT | TAXI OUT | T-O | REJ T-O | INIT CLMB | E/R CLMB | CRS | DESC | APPR | GO ARND | LDG | TAXI IN | ENG OFF | POST FLT |
| SUBJECT | LA ... | SLSS | SLSS | LMMM | SMMM | LMMM | MMMM | LMMM | MLLL | MLSS | MMSS | MMSL | MMLL | MMMM | MMMM | MMMM | MMML |
| | LB 306 | MMML | MMMM | MMMM | MMMM | MMMM | MMMM | MMMM | MMMM | MMLL | MMLL | MMMM | MMMM | MMMM | MMMM | MMMM | MMMM |
| | LC ... 304 | SLSS | SLSS | LMMM | SMMM | LMMM | LMMM | LMMM | MLLL | MLSS | MMSS | MMSL | MMLL | MMMM | MMMS | MMMM | MMMS |
| | LD ... | MMML | MMMM | MMMM | MMMM | MMMM | MMMM | MMMM | MMMM | MMLL | MMLL | MMMM | MMMM | MMMM | MMMM | MMMM | MMML |
| | LX ... | SLSS | SLSS | LMMM | SMMM | LMMM | LMMM | LMMM | MLLL | MLSS | MMSS | MMSL | MMLL | MMMM | MMMS | MMMM | MMMS |
| 307 AIRSPACE RESTRICTIONS (R) | | PLN | PRE FLT | ENG STRT | TAXI OUT | T-O | REJ T-O | INIT CLMB | E/R CLMB | CRS | DESC | APPR | GO ARND | LDG | TAXI IN | ENG OFF | POST FLT |
| SUBJECT | RA ... | SSSS | SSSS | LMMM | SMMM | LLMM | MMMM | SLMM | MSLL | MSSS | MLSS | MMML | MMLL | MMMM | MMMM | MMMM | MMMS |
| | RD ... | SSSS | SSSS | LMMM | SMMM | LLMM | MMMM | SLMM | MSLL | MSSS | MLSS | MMML | MMLL | MMMM | MMMM | MMMM | MMMS |
| | RM ... | SSSS | SSSS | LMMM | SMMM | LLMM | MMMM | SLMM | MSLL | MSSS | MLSS | MMML | MMLL | MMMM | MMMM | MMMM | MMMS |
| | RO ... | SSSS | SSSS | LMMM | SMMM | LLMM | MMMM | SLMM | MSLL | MSSS | MLSS | MMML | MMLL | MMMM | MMMM | MMMM | MMMM |
| | RP ... | SSSS | SSSS | LMMM | SMMM | LLMM | MMMM | SLMM | MSLL | MSSS | MLSS | MMML | MMLL | MMMM | MMMM | MMMM | MMMS |

302

| NOTAM STATUS | | | NOTIFICATION ACTIVATION CODE |
|---|---|---|---|
| STATUS | AD | AVAIL FOR DAYLIGHT OPERATIONS | U |
| | AL | OPERATIVE | U |
| | AS | UNSERVICEABLE | E |
| | HX | CONCENTRATION OF BIRDS | E |
| | LC | CLOSED | E |

308

310 312

| | |
|---|---|
| E | IS EFFECTIVE |
| U | CHANGES TO M |

314 128

| | | |
|---|---|---|
| S | SIGNIFICANT | 1(AURAL/VISUAL/TEXTUAL) |
| L | LIMITED | 2(VISUAL/TEXTUAL) |
| M | MINOR | 3(TEXTUAL – INFO BOX) |
| N | NONRELEVANT | 4(ONLY IN NOTAM PKG) |

*Fig. 3*

SELECTIVE NOTAM NOTIFICATION

BACKGROUND

Pilots and other aircraft crew members rely on many sources of information to accurately and safely plan and prepare for flights. A significant quantity of this information is relatively unchanging with respect to a particular route and/or aircraft, such as distances between fixed points, aircraft capabilities, and airport/runway configurations. However, there is also a large quantity of information that may or may not be important to a pilot based on the particular route being flown, or on the particular phase of flight. For example, a destination airport may be undergoing repair operations on one or more runways, an air show or skydiving operations may be taking place at an alternative airport or other location en route to the final destination, or there may be volcanic ash at certain altitudes due to recent volcano activity in the vicinity of the flight path of the aircraft. This type of information is typically provided to all pilots by a government agency in the form of notices to airmen (NOTAMs).

A typical flight planning scenario might include a pilot receiving ten to fifty pages of NOTAMs prior to the flight. While some of this information may be critically important to one or more phases of the flight being planned, other portions of the information may have no relevance, or limited relevance, to the upcoming flight. The pilot or crew must parse through all of the NOTAMs to manually determine which NOTAMs are applicable to the upcoming flight, and to ascertain the importance of the applicable NOTAMs. Even though conventional airline pilots may have NOTAM information in electronic form utilizing an electronic flight deck, they must still sort through the NOTAMs to match the applicable information to the flight being planned. This process is cumbersome and inefficient, which increases the pilot's workload and creates an opportunity for errors to be made as important information may be missed.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Methods, systems, and computer-readable storage media described herein provide for the selective notification of relevant NOTAMs according to a target phase of flight. The concepts and technologies disclosed herein allow for various types of notifications of applicable NOTAMs to be made to the pilots depending on the phase of flight that the aircraft is currently in, or any other desired phase of flight, and the determined level of relevance of each NOTAM. As a result, the pilots are able to much more quickly and efficiently review the NOTAMs that apply to their selected flight phase without having to sort through large quantities of NOTAMs, many of which have relatively little effect on the current flight or selected phase of flight.

According to one aspect of the disclosure provided herein, a number of NOTAMs are received. The target or selected phase of flight is determined and used to determine a relevance for each of the NOTAMs. A notification of one or more NOTAMs is provided according to the relevance of the NOTAMs for the target phase of flight.

According to another aspect, a NOTAM notification computer system includes a NOTAM notification processor, a memory, and a NOTAM notification application executed by the processor. When executed, the NOTAM notification application allows for relevant NOTAMs to be provided to a crew of an aircraft according to a target phase of flight. A number of NOTAMs are received and the current phase of flight is determined, if applicable. A set of relevance rules are retrieved and used to determine a relevance for each of the NOTAMs. The relevance rules include a relevance code for each NOTAM subject code at each phase of flight. A notification of one or more NOTAMs is provided according to the determined relevance for the current or target phase of flight.

According to yet another aspect, a NOTAM is received and the selected phase of flight is determined. A relevance is determined for the NOTAM according to the subject of the NOTAM and according to the selected phase of flight. A status of the NOTAM is determined and used to update the determined relevance if necessary. This updated relevance is used to determine a notification method and the applicable notification is made.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

FIG. 3 is an illustrative table showing an example set of NOTAM relevance rules according to various embodiments presented herein;

DETAILED DESCRIPTION

The following detailed description is directed to methods, systems, and computer-readable storage media for selecting relevant NOTAMs corresponding to the current or other selected phase of flight of an aircraft and providing appropriate notifications to the crew. As discussed briefly above, parsing through the vast quantity of NOTAMs for any given flight is a task that consumes a significant amount of time and creates a risk that valuable information will be missed during the cumbersome process. Utilizing the concepts and technologies described herein, pilots are provided with various levels or types of notifications corresponding to the relevance of the NOTAMs that apply to a specific phase of flight that is of interest to the pilot.

Figure 1:
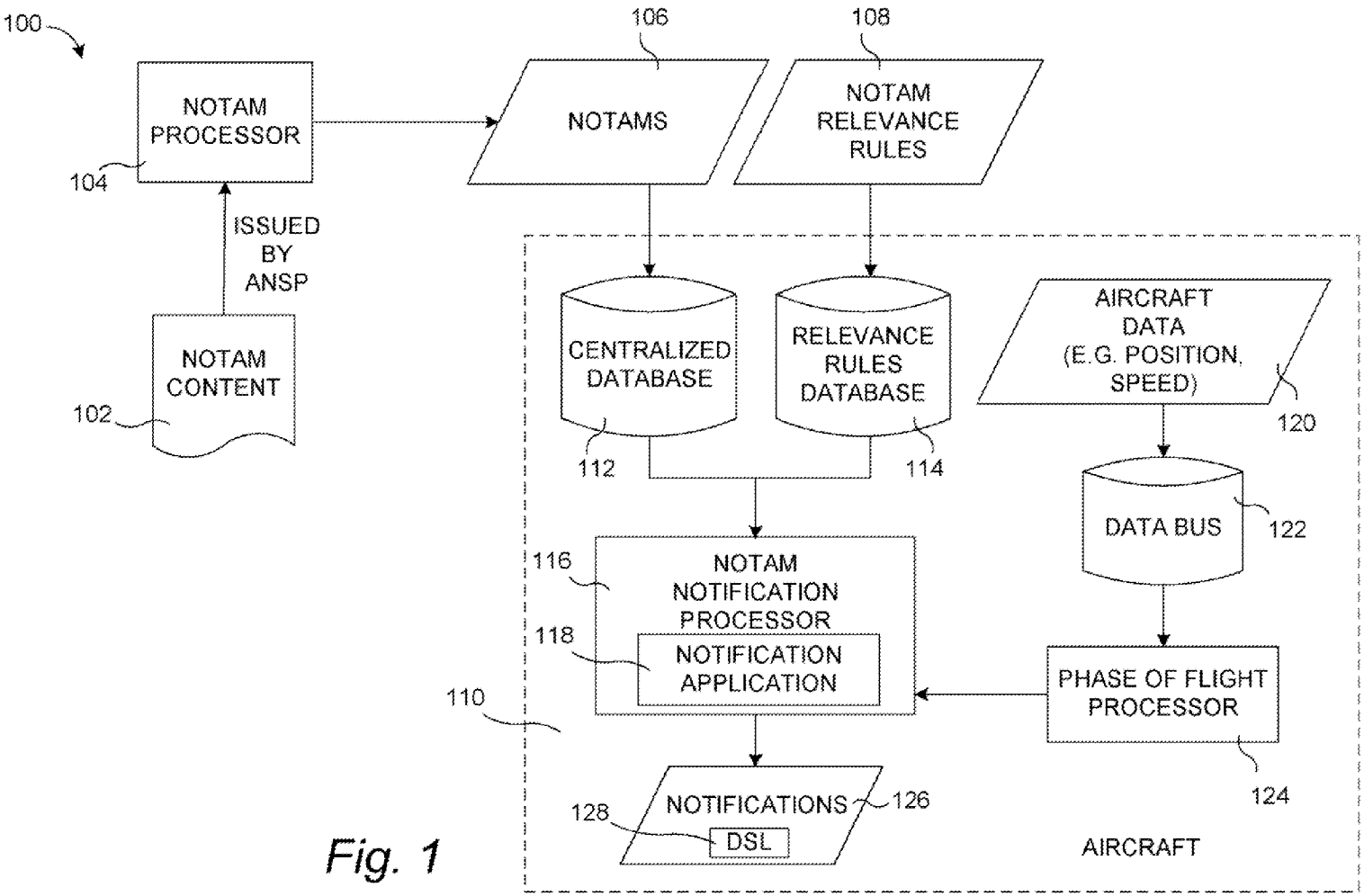
FIG. 1 is a block diagram showing a NOTAM notification system and the flow of NOTAM content through the system to create a notification according to various embodiments presented herein.

In the following detailed description, references are made to the accompanying drawings that form a part hereof, and which are shown by way of illustration, specific embodiments, or examples. Referring now to the drawings, in which like numerals represent like elements through the several figures, the selective notification of relevant NOTAMs will be described. FIG. 1 shows a NOTAM notification system 100 according to one embodiment described herein. According to this embodiment, the NOTAM notification system 100 includes a ground-based NOTAM processor 104 that receives NOTAM content 102 from any number of NOTAMs issued by an Air Navigation Service Provider (ANSP). The NOTAM processor 104 processes the NOTAM content 102 into electronic NOTAMs 106 for use by the components of the NOTAM notification system 100 installed within an aircraft 110.

The NOTAMs 106 are uploaded to the aircraft 110 and stored in a centralized database 112 or other data repository for access by a NOTAM notification processor 116. The NOTAM notification processor 116 executes a notification application 118 that is operative to perform the various operations described herein. Specifically, the NOTAM notification processor 116 utilizes the electronic NOTAMs 106 stored within the centralized database 112, in combination with a set of NOTAM relevance rules 108 stored within a relevance rules database 114 or other data repository on the aircraft 110, and with phase of flight information provided by a phase of flight processor 124, to determine which NOTAMs 106 to provide to the crew of the aircraft 110, as well as to select a format in which to provide the notification 126.

The NOTAM relevance rules 108 are a set of rules that establish the relevancy of NOTAMs according to the subject of the various NOTAMs and to the phase of flight of the aircraft 110. The NOTAM relevance rules 108 will be described in greater detail below with respect to FIG. 3. The rules are stored in a relevance rules database 114 or other data repository on the aircraft 110. It should be appreciated that the centralized database 112 and the relevance rules database 114 may be the same database, or may be separate data repositories.

In order to determine the relevance of each NOTAM 106, the notification application 118 utilizes the current phase of flight, or any other phase of flight selected by the pilot or other user, as applicable. The various phases of flight and how this information is used to determine the relevance will be discussed in greater detail below with respect to FIGS. 2 and 3. For the purposes of FIG. 1, the phase of flight processor 124 utilizes any quantity and type of aircraft data 120 received via a data bus 122 to determine the current phase of flight, if the current phase of flight is of immediate interest. For example, the phase of flight processor 124 may utilize a global positioning system (GPS) receiver to determine the precise geographic location of the aircraft 110. With this information, coupled with current aircraft speed information and the corresponding programmed flight route, the current location or current phase of flight of the aircraft 110 can be easily determined, for example, that the aircraft 110 is taxiing out to the runway at the departure airport. Alternatively, according to other embodiments, the pilot, dispatcher, or other requesting party may select the phase of flight that is of interest. Using this selected, or target, phase of flight, the notification application 118 may provide the relevant NOTAMs 106 according to the methods described herein.

If the target phase of flight is the current phase of flight, then any type of aircraft data 120 may be used to determine the current phase of flight, including but not limited to, aircraft position, speed, altitude, climb and/or descent rates, control surface positioning, landing gear positioning, engine settings, and/or the time of day. The phase of flight processor 124 receives the applicable aircraft data 120, processes the data to determine the current phase of flight, and provides that information to the notification application. It should be understood that while the phase of flight processor 124 is shown to be a separate component from the NOTAM notification processor 116, these two processors may be a single processor of a flight computer installed in the aircraft 110.

After determining the relevance of each NOTAM 106 to the current or other target phase of flight, the notification application 118 determines how the crew of the aircraft 110 should be notified and provides the corresponding notifications 126. As will be discussed in further detail below, the notifications 126 vary according to the relevance of the NOTAM 106 to the crew at the target phase of flight. The level of relevance of each NOTAM 106 triggers a display and signaling level (DSL) 128 that instructs the notification application 118 as to the method of notification to be used when providing the NOTAM 106 to the pilot. For example, if the notification application 118 determines that a NOTAM 106 has a "Significant" relevance to the crew during the target phase of flight, then the corresponding DSL 128 would be "1", which indicates that the notification 126 be made to the pilot in the form of an aural, visual, and textual notification.

Figure 2:
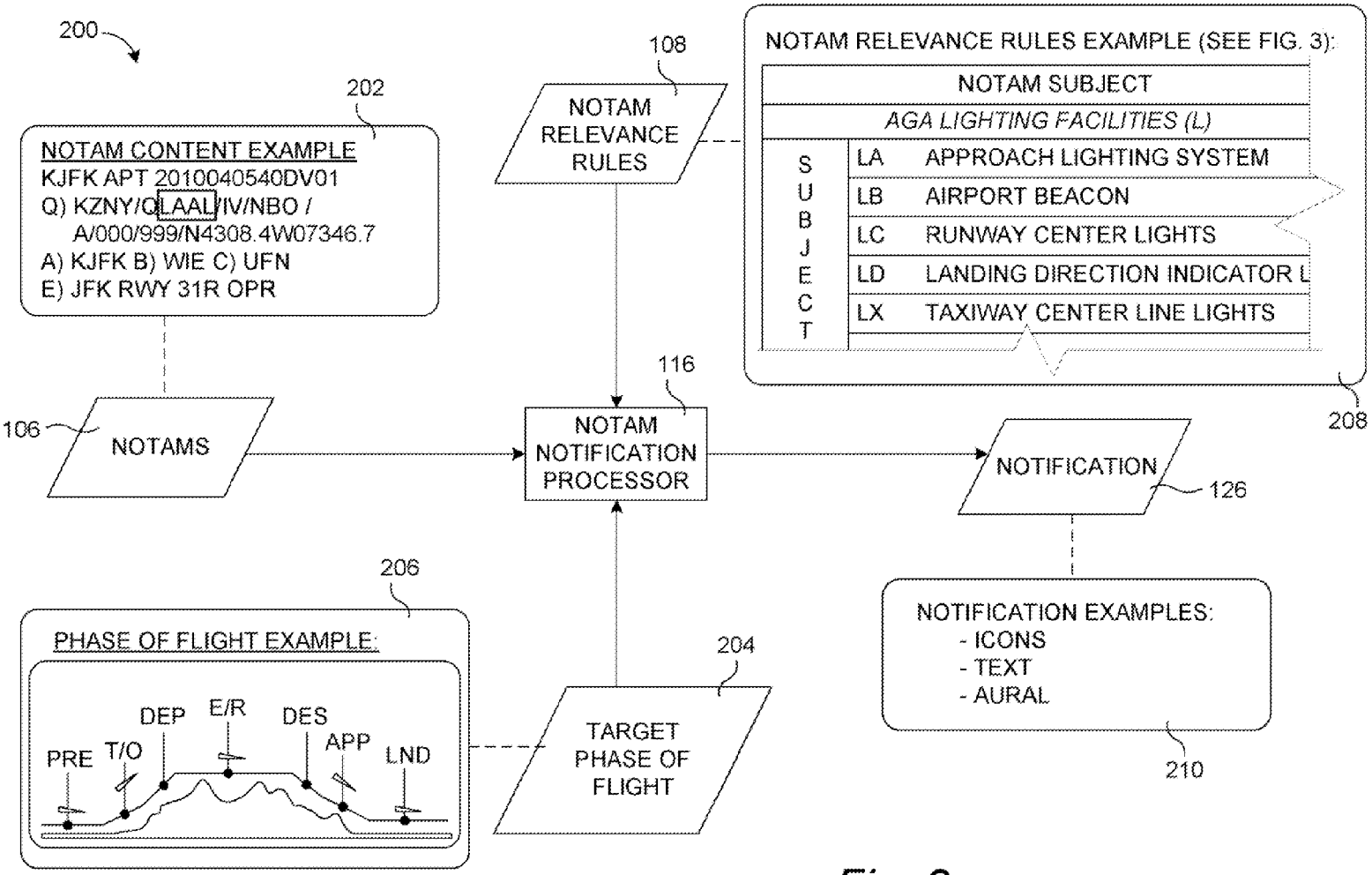
FIG. 2 is a data flow diagram illustrating the data input and output to and from a NOTAM notification processor of an aircraft according to various embodiments presented herein.

Turning to FIG. 2, the data that is utilized by the NOTAM notification processor 116 to create the appropriate notification 126 according to one embodiment will be discussed in further detail. The NOTAM notification system data flow 200 depicts various examples of the data that is received by the NOTAM notification processor 116 and transformed into one or more notifications 126 that are delivered according to the determined level of relevance of the corresponding NOTAMs 106. As seen in FIG. 2, a NOTAM content example 202 shows a NOTAM that includes a Q-code "LAAL." This code is utilized by the NOTAM notification processor 116 to determine the subject of the NOTAM 106, as well as the current status of the NOTAM 106. The first two letters of this code, "LA," represent the subject code of the NOTAM 106, while the remaining two letters, "AL," represent the status code. Every NOTAM 106 includes a subject code and status code that may be used by the NOTAM notification processor 116 to determine the appropriate relevance of the corresponding NOTAMs 106 from the NOTAM relevance rules 108.

The NOTAM relevance rules 108 provide relevance indicators for every phase of flight for each NOTAM subject. A NOTAM relevance rules example 208 is partially shown in FIG. 2 and is shown, and will be described, with greater detail with respect to FIG. 3. As suggested above, FIG. 2 is intended as a general overview to demonstrate the type of information that flows into the NOTAM notification processor 116 and is transformed into applicable notifications 126 for the pilots. The specific NOTAM content example 202, and others, will be explored in detail using the NOTAM relevance rules example 208 below with respect to FIG. 3.

The NOTAM notification processor 116 utilizes the target phase of flight 204 to effectively aid the determination of which NOTAMs 106 are relevant to the aircraft crew. If, for example, a condition exists at an alternate destination airport, it might not be relevant to the pilot while taxiing out to take off from the departure airport. Consequently, according to embodiments described herein, if the target phase of flight 204 is the phase of flight that the aircraft 110 is currently in, the NOTAM notification processor would assign a lower relevance to a NOTAM 106 containing this information about the alternate destination airport during the taxi and takeoff phases of flight, but would increase the relevance of this NOTAM 106 as the aircraft 110 progressed toward the destination airport.

According to various embodiments, a flight may be broken down into any number of phases for the purposes of providing relevant NOTAMs 106 to the pilots. For example, the phase of flight example 206 shown in FIG. 2 shows seven phases of flight, corresponding to preflight, takeoff, departure, en route, descent, approach, and landing phases of flight. However, as seen in the NOTAM relevant rules example 208 shown in FIG. 3, sixteen phases of flight are represented, including flight planning, pre-flight, engine start, taxi-out, takeoff, rejected takeoff, en route climb, cruise, descent, approach, go-around, landing, taxi-in, engine shutdown, and post-flight phases of flight. It should be appreciated that the greater the number of phases of flight incorporated into the NOTAM relevance rules 108 and detectable by the phase of flight processor 124, the greater the ability of the notification application 118 to provide the most relevant information to the pilots in the most efficient manner. However, more or fewer phases of flight may be utilized without departing from the scope of this disclosure.

After determining the target phase of flight 204, the NOTAM notification processor 116 utilizes this information, along with the subject and status codes from the NOTAMs 106, to determine the relevance of the NOTAM 106 to the target phase of flight. Depending on the determined relevance of the various NOTAMs 106, the NOTAM notification processor 116 will provide corresponding notifications 126. As will become clear from the detailed examples discussed below, these notifications 126 may include various formats, including but not limited to icons, textual notifications, aural notifications, or the conventional notifications available in a conventional NOTAM package.

Turning now to FIG. 3, an illustrative example 208 of a set of relevance rules 108 will now be described according to one embodiment. The relevance rules example 208 includes a NOTAM subject section 302 that lists all potential NOTAM subjects and the corresponding subject codes 306. The subject codes 306 may be grouped according to subject categories 307. For instance, according to the simplified relevance rules example 208 shown here, there are two subject categories 307 corresponding to "Lighting Facilities" and "Airspace Restrictions." In practice, there may be any number of subject categories 307. Within each subject category 307, there is a list of subject codes 306 pertaining to that category. The subject codes 306 are two letter codes found in every NOTAM 106 and identifiable by the NOTAM notification processor 116, which parses the NOTAMs 106 to extract the subject codes 306.

The subject category 307 sections of the rules may additionally include the textual description of each subject code 306, as shown in FIG. 2, but replaced by ellipsis in FIG. 3 to conserve space for clarity purposes. In a row next to each subject code 306 is a group of relevance codes 304, with one code placed in each column corresponding to a current phase of flight 204. For example, the subject code "LA" represents NOTAMs 106 concerning approach lighting systems and includes the relevance code "SLSS" corresponding to the flight planning phase of flight, the relevance code "SLSS" corresponding to the pre-flight phase of flight, the relevance code "LMMM" corresponding to the engine start phase of flight, and so forth.

The relevance codes 304 may include a multi-letter code, with each letter associated with the relevance of the NOTAM subject code 306 in the context of a particular flight segment along the flight route and/or one or more airports associated with that flight segment. The specific letter used represents the level of relevance. For example, according to the NOTAM relevance rules example 208, each relevance code 304 is a four letter code. The first letter corresponds to the departure airport or other alternative departure airport, or to the departure segment of flight of the planned flight route.

The second letter corresponds to an en route airport or other airport under Extended Range Twin-Engine Operational Performance Standards (ETOPS) guidelines, or to the en route segment of flight of the planned flight route. The third letter corresponds to the alternate destination airports. The fourth letter corresponds to the destination airport or to the arrival segment of flight of the planned flight route. The letter itself identifies the level of relevance of the associated NOTAM subject. According to one embodiment, the letters may be "S" for "Significant," "L" for "Limited," "M" for "Minor," or "N" for "Non-relevant." It should be appreciated that any number of letters, numbers, or symbols may be used as the relevance codes 304. For example, according to an alternative embodiment, the relevance codes 304 each contain three letters, corresponding to the departure, en route, and arrival flight segments, respectively. Similarly, the letters are not limited to "S," "L," "M," and "N." Rather, any quantity and type of relevance indicators can be used within the relevance codes 304.

As an example that illustrates how the NOTAM notification processor 116 determines the relevance of any given NOTAM 106 using the NOTAM relevance rules 108, assume a NOTAM 106 includes the subject code "LX" and a status code of "AS" corresponding to the taxiway center line lights of a departure airport being unserviceable. The NOTAM notification processor 116 determines the current phase of fight 204 to be the planning phase due to aircraft location and timing. Utilizing the NOTAM relevance rules 108, the NOTAM notification processor 116 determines that the relevance code 304 corresponding to the "LX" subject code 306 and "planning" as the current phase of flight to be "SLSS." Therefore, the relevance of this NOTAM 106 at the departure airport is "Significant."

All available status codes 310 of NOTAMs 106 are listed with descriptions in the NOTAM status section 308 of the NOTAM relevance rules 108 according to one embodiment. As described above with respect to the NOTAM subject section 302, the NOTAM status section 308 may have any number of status categories that group together similar status codes 310. For purposes of clarity, a limited number of status codes 310 are shown, and they share a single category.

According to one embodiment, each status code 310 is assigned a notification activation code 312. The notification activation code 312 instructs the NOTAM notification processor 116 as to whether the applicable relevance indicator of the associated relevance code 304 remains effective or is no longer effective. If effective, the relevance indicator remains the same, but if no longer effective, the relevance indicator is downgraded. According to the embodiment shown in FIG. 3, the notification activation code 312 is an "E" if the NOTAM 106 remains effective and a "U" if no longer effective.

Continuing the example with the subject code 306 of "LX" and status code of "AS," the status code 310 corresponds to a notification activation code 312 of "E" since taxiway center line lights being inoperative is a condition for which the pilot would want to be notified. If a condition has improved so that the subject of the NOTAM 106 is now operative or available, the notification activation code 312 is likely to be "U," which would downgrade the relevance indicator of the associated relevance code 304 from "S" to "M," for example. However, in this example, because the notification activation code 312 is "E," the relevance code 304 remains "SLSS."

As stated above, the level of relevance of each NOTAM 106 triggers a DSL 128 that instructs the notification application 118 as to the method of notification to be used when providing the NOTAM 106 to the pilot. Continuing the example, as shown in the box 314 in the lower right portion of FIG. 3, the notification application 118 determines that the NOTAM 106 has a "Significant" relevance to the crew during the current phase of flight 204, which corresponds to a DSL 128 of "1." The DSL 128 of "1" indicates that the notification 126 be made to the pilot in the form of an aural, visual, and textual notification 126. If the DSL 128 is "2," then only visual and textual notifications 126 are made. A DSL of "3" triggers a textual notification within an information box, and a DSL of "4" results in no additional notification other than the conventional NOTAM package. Various methods of providing notifications 126, such as utilizing icon-based notifications, are disclosed in co-pending U.S. patent application Ser. No. 12/689,600, which is herein incorporated by reference in its entirety.

As another example in which the relevance code 304 is downgraded according to the notification activation code 312, refer again to the NOTAM content example 202 shown in FIG. 2. In this example, the code "LAAL" indicates a NOTAM subject code of "LA." If the aircraft 110 is currently in the descent phase of flight 204 and the target phase of flight 204 is the current phase of flight, the correct relevance code 304 would be "MMSS" since the approach lighting system of the destination alternative airport would have a significant relevance to a descending aircraft. However, the status code 310 is "AL," which corresponds to "operative." Because highlighting an operative lighting system to a pilot is less important than highlighting an inoperative approach lighting system, the notification activation code 312 is "U," which changes the relevance indicator "S" to "M." As seen in box 314, a "Minor" relevance triggers a DSL of "3." As a result, this NOTAM 106 might be placed in an information box in textual form for the pilot's review, without any aural warnings or any other icon or other graphical-based notifications.

It should be noted that the relevance rules example 208 shown in FIG. 3, while more comprehensive than the same depiction in FIG. 2, is only a small portion of a set of NOTAM relevance rules 108 used in practice. In practice, there may be a substantially larger set of NOTAM subjects 302 and corresponding two letter subject codes 306, as well as an expanded NOTAM status section 310 with corresponding two letter subject codes 312. It should also be clear that the relevance rules example 208 shown in FIG. 3 depicts only one illustrative example of a set of NOTAM relevance rules 108. According to various embodiments, any quantity and type of target phase of flight 204 identifiers may be included, and any quantity and type of letters or numbers may be used within the corresponding relevance codes 304, without departing from the scope of this disclosure.

Figure 4:
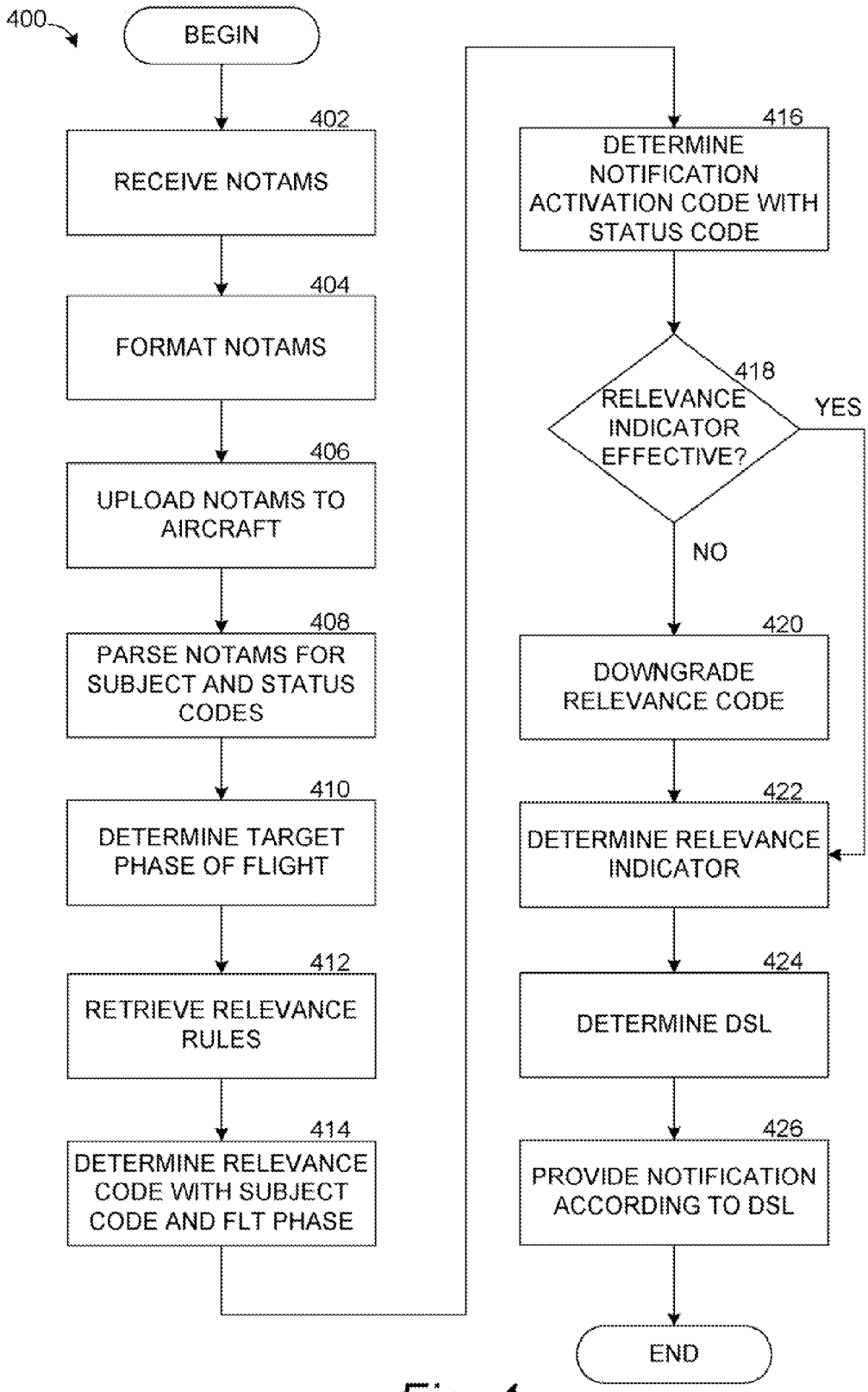
FIG. 4 is a process flow diagram illustrating a method for providing selective NOTAM notifications according to various embodiments presented herein.

Turning now to FIG. 4, an illustrative routine 400 for providing selective notification of NOTAMs according to relevance to the target phase of flight will now be described in detail. It should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as operations, structural devices, acts, or modules. These operations, structural devices, acts and modules may be implemented in software, in firmware, in special purpose digital logic, and any combination thereof. It should also be appreciated that more or fewer operations may be performed than shown in the figures and described herein. These operations may also be performed in a different order than those described herein.

The routine 400 begins at operation 402, where a number of NOTAMs are received. The NOTAMs 106 are formatted in an electronic format that can be easily parsed by the notification application 118 for subject and status codes at operation 404. The routine 400 continues to operation 406, where the NOTAMs 106 are uploaded to the aircraft 110. At operation 408, the notification application 118 parses the NOTAMs 106 for NOTAM subject codes 306 and NOTAM status codes 310. From operation 408, the routine 400 continues to operation 410, where the notification application 118 determines the target phase of flight 204. For example, if the relevant NOTAMs 106 for the current phase of flight are requested, the notification application 118 may do this directly using real-time aircraft data 120, or may receive or retrieve this information from the phase of flight processor 124. If the current phase of flight is not the requested target phase of flight 204, then the target phase of flight 204 would simply be the phase of flight selected by the requesting party.

The routine 400 continues from operation 410 to operation 412, where the notification application 118 retrieves the NOTAM relevance rules 108 from the relevance rules database 114. The applicable relevance codes 304 are determined using the NOTAM subject codes 306 and the target phase of flight 204 at operation 414. From operation 414, the routine 400 continues to operation 416, where the notification application 118 determines the notification activation codes 312 that are associated with the NOTAM status codes 310 for all of the received NOTAMs 106.

At operation 418, a determination is made for each NOTAM 106 as to whether or not the applicable relevance indicator is effective. As discussed above, the notification activation code 312 associated with each status code 310 of each NOTAM 106 indicates whether the applicable relevance indicator of the corresponding relevance code 304 is effective. If the relevance indicator is effective, the relevance code 304 for that NOTAM 106 remains the same and the routine 400 proceeds from operation 418 to operation 422 and continues as described below. However, if at operation 418, the notification application 118 determines from the notification activation code 312 for a given NOTAM 106 that the relevance indicator is not effective, then the routine 400 continues to operation 420, where the relevance code 304 is downgraded, such as changing a "Significant" relevance indicator to a "Minor" relevance indicator.

From operation 420, the routine 400 continues to operation 422, where the relevance indicators are determined for each NOTAM 106. As previously discussed, these indicators may correspond to various flight segments and/or airports throughout the planned flight route and provide an indication as the level of relevance that the NOTAM 106 has to that flight segment or airport based on the target phase of flight 204. The applicable relevance indicators trigger a DSL 128 that instructs the notification application 118 as to the method of notification to be used when providing the NOTAM 106 to the pilot. After determining the DSLs 128 at operation 424, the routine 400 continues to operation 426, where the applicable notifications 126 are provided to the crew of the aircraft 110 according to the DSLs 128.

Figure 5:
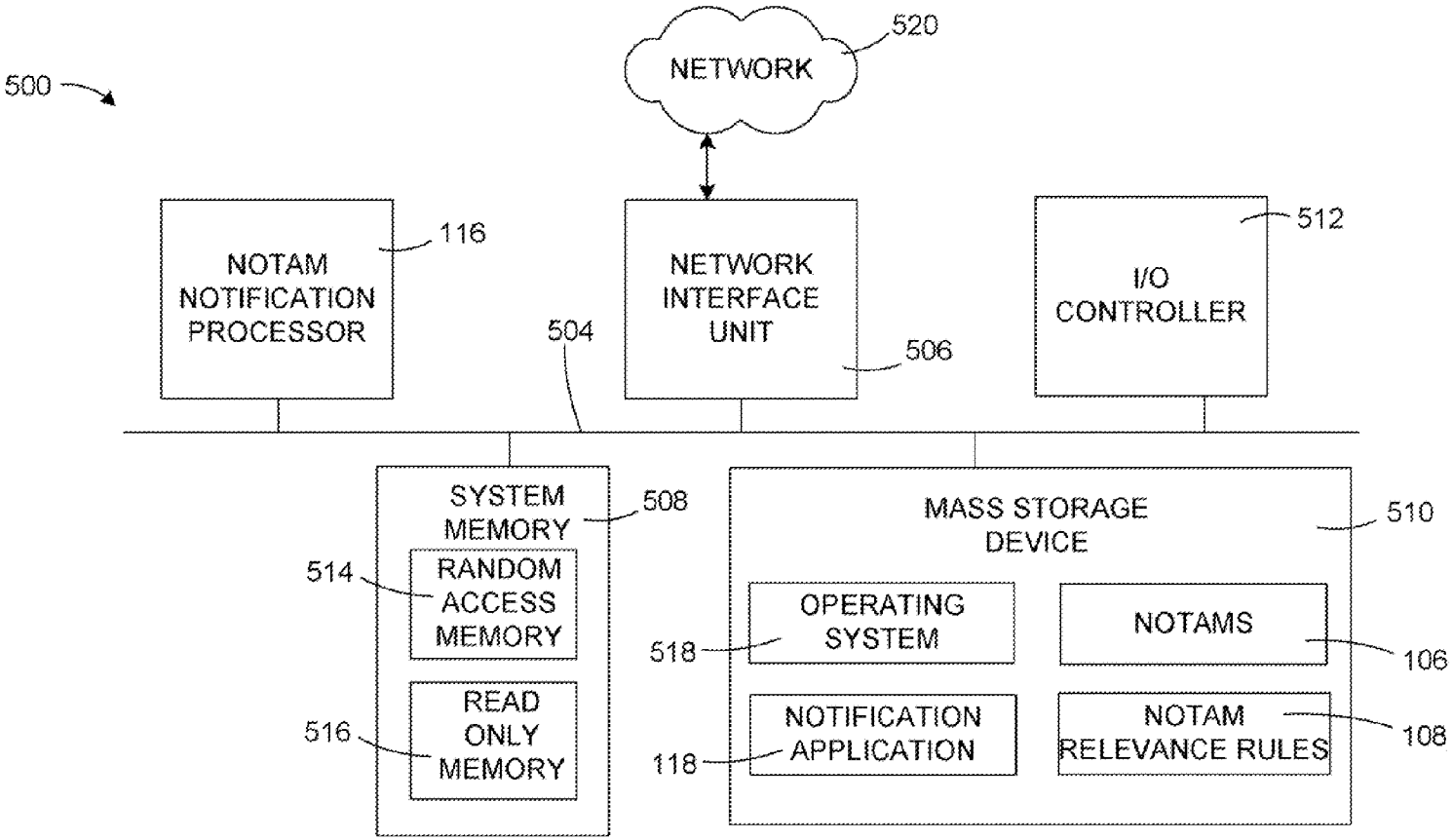
FIG. 5 is a computer architecture diagram showing an illustrative computer hardware and software architecture for a computing system capable of implementing the embodiments presented herein.

FIG. 5 shows an illustrative computer architecture for a computer 500 capable of executing the software components described herein for providing NOTAM notifications according to relevance to a target phase of flight 204. The computer architecture shown in FIG. 5 illustrates a conventional desktop, laptop computer, server computer, or any flight computer configured for use with an aircraft system and may be utilized to implement the computer 500 and to execute any of the other software components described herein.

The computer architecture shown in FIG. 5 includes a NOTAM notification processor 116, a system memory 508, including a random access memory 514 (RAM) and a read-only memory (ROM) 516, and a system bus 504 that couples the memory to the processor 116. A basic input/output system (BIOS) containing the basic routines that help to transfer information between elements within the computer 500, such as during startup, is stored in the ROM 516. The computer 500 further includes a mass storage device 510 for storing an operating system 518, application programs, and other program modules, which will be described in greater detail below.

The mass storage device 510 is connected to the PROCESSOR 116 through a mass storage controller (not shown) connected to the bus 504. The mass storage device 510 and its associated computer-readable media provide non-volatile storage for the computer 500. Although the description of computer-readable media contained herein refers to a mass storage device, such as a hard disk or CD-ROM drive, it should be appreciated by those skilled in the art that computer-readable storage media can be any available computer storage media that can be accessed by the computer 500.

By way of example, and not limitation, computer-readable storage media may include volatile and non-volatile, removable and non-removable media implemented in any method or technology for storage of information such as computer-readable instructions, data structures, program modules or other data. For example, computer-readable storage media includes, but is not limited to, RAM, ROM, EPROM, EEPROM, flash memory or other solid state memory technology, CD-ROM, digital versatile disks (DVD), HD-DVD, BLU-RAY, or other optical storage, magnetic cassettes, magnetic tape, magnetic disk storage or other magnetic storage devices, or any other medium which can be used to store the desired information and which can be accessed by the computer 500. As used herein, the term computer-readable storage media does not encompass transitory signals.

According to various embodiments, the computer 500 may operate in a networked environment using logical connections to remote computers through a network such as the network 520. The computer 500 may connect to the network 520 through a network interface unit 506 connected to the bus 504. It should be appreciated that the network interface unit 506 may also be utilized to connect to other types of networks and remote computer systems. The computer 500 may also include an input/output controller 512 for receiving and processing input from a number of other devices, including a keyboard, mouse, or electronic stylus (not shown in FIG. 5). Similarly, an input/output controller may provide output to a display screen, a printer, or other type of output device (also not shown in FIG. 5).

As mentioned briefly above, a number of program modules and data files may be stored in the mass storage device 510 and RAM 514 of the computer 500, including an operating system 518 suitable for controlling the operation of a networked desktop, laptop, server, or other flight computer. The mass storage device 510 and RAM 514 may also store one or more program modules. In particular, the mass storage device 510 and the RAM 514 may store the NOTAMs 106, the NOTAM relevance rules 108, and the notification application 118 and any corresponding modules described above. The mass storage device 510 and RAM 514 may also store other program modules and data.

In general, software applications or modules may, when loaded into the processor 116 and executed, transform the processor 116 and the overall computer 500 from a general-purpose computing system into a special-purpose computing system customized to perform the functionality presented herein. The processor 116 may be constructed from any number of transistors or other discrete circuit elements, which may individually or collectively assume any number of states. More specifically, the processor 116 may operate as one or more finite-state machines, in response to executable instructions contained within the software or modules. These computer-executable instructions may transform the processor 116 by specifying how the processor 116 transitions between states, thereby physically transforming the transistors or other discrete hardware elements constituting the processor 116.

Encoding the software or modules onto a mass storage device may also transform the physical structure of the mass storage device or associated computer-readable storage media. The specific transformation of physical structure may depend on various factors, in different implementations of this description. Examples of such factors may include, but are not limited to: the technology used to implement the computer-readable storage media, whether the computer-readable storage media are characterized as primary or secondary storage, and the like. For example, if the computer-readable storage media is implemented as semiconductor-based memory, the software or modules may transform the physical state of the semiconductor memory, when the software is encoded therein. For example, the software may transform the states of transistors, capacitors, or other discrete circuit elements constituting the semiconductor memory.

As another example, the computer-readable storage media may be implemented using magnetic or optical technology. In such implementations, the software or modules may transform the physical state of magnetic or optical media, when the software is encoded therein. These transformations may include altering the magnetic characteristics of particular locations within given magnetic media. These transformations may also include altering the physical features or characteristics of particular locations within given optical media, to change the optical characteristics of those locations. Other transformations of physical media are possible without departing from the scope and spirit of the present description, with the foregoing examples provided only to facilitate this discussion.

Based on the foregoing, it should be appreciated that technologies for providing NOTAM notifications according to relevance to the target phase of flight of an aircraft have been presented herein. Although the subject matter presented herein has been described in language specific to computer structural features, methodological acts, and computer readable media, it is to be understood that the invention defined in the appended claims is not necessarily limited to the specific features, acts, or media described herein. Rather, the specific features, acts and storage mediums are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A computer-implemented method for selectively providing Notice To Airmen (NOTAM) notifications to a crew of an aircraft, the computer-implemented method comprising the following steps:

receiving a plurality of NOTAMs;

assigning a NOTAM subject code to each NOTAM;

assigning a relevance code to each NOTAM subject code for each of a plurality of predetermined phases of flight including at least preflight, takeoff, departure, en route, descent, approach and landing phases of flight of a planned flight route of the aircraft, and wherein each relevance code comprises multiple relevance indicators, each relevance indicator providing an indication of the relevance of the NOTAM subject code corresponding to an airport associated with each of the plurality of predetermined phases of flight of the planned flight route, the multiple relevance indictors comprise multiple letters defining a multi-letter code, each of the multiple letters providing an indication of a relevance of the NOTAM subject code corresponding to the airport during a corresponding phase of flight of the planned flight route;

determining a target phase of flight of the plurality of phases of flight associated with the aircraft;

determining the relevance for each of the plurality of NOTAMs according to the relevance code associated with the NOTAM subject code during the target phase of flight; and providing a notification of one or more of the plurality of NOTAMs according to the relevance for the target phase of flight.

2. The computer-implemented method of claim 1, wherein the target phase of flight further comprises a current phase of flight, and wherein determining the current phase of flight associated with the aircraft further comprises retrieving real-time aircraft data collected from one or more aircraft sensors and utilizing the real-time aircraft data to determine the current phase of flight.

3. The computer-implemented method of claim 1 wherein determining the relevance for each of the plurality of NOTAMs according to the target phase of flight further comprises retrieving the relevance code corresponding to the target phase of flight, and wherein providing the notification of one or more NOTAMs according to the relevance for the target phase of flight comprises determining one or more types of notifications to provide according to each relevance code and providing the one or more types of notifications.

4. The computer-implemented method of claim 1, wherein the relevance code further comprises a four-letter code such that a first letter is associated with a departure airport or departure segment of flight, a second letter is associated with an alternative en route airport or en route segment of flight, a third letter is associated with an alternative destination airport, and a fourth letter is associated with a destination airport or arrival segment of flight.

5. The computer-implemented method of claim 1, further comprising:

determining a NOTAM status for each of the plurality of NOTAMs;

determining a notification activation code for each NOTAM status; and modifying the relevance code according to the notification activation code.

6. The computer-implemented method of claim 5, wherein the notification activation code further comprises an indicator that the corresponding NOTAM is effective or an indicator that the corresponding NOTAM is not effective, wherein if the notification activation code comprises the indicator that the corresponding NOTAM is not effective, then the relevance code is modified to downgrade the relevance prior to determining the one or more types of notifications to provide.

7. The computer-implemented method of claim 1, wherein the computer-implemented method completes each of the steps at least once during each phase of flight of the aircraft such that the crew of the aircraft is provided with applicable NOTAMs during each phase of flight according to relevance to the phase of flight.

8. A NOTAM notification computer system, comprising:

a NOTAM notification processor;

a memory communicatively coupled to the NOTAM notification processor; and a NOTAM notification application (i) which executes in the NOTAM notification processor and (ii) which, when executed by the NOTAM notification processor, causes the NOTAM notification computer system to provide relevant NOTAMs to a crew of an aircraft according to a target phase of flight by receiving a plurality of NOTAMs, assigning a NOTAM subject code to each NOTAM, assigning a relevance code to each NOTAM subject code for each of a plurality of predetermined phases of flight including at least preflight, takeoff, departure, en route, descent, approach and landing phases of flight of a planned flight route of the aircraft, wherein the relevance code comprises multiple relevance indicators, each relevance indicator indicating the relevance of the NOTAM subject code corresponding to an airport associated with each of the plurality of predetermined phases of flight of the planned flight route, the multiple relevance indictors comprise multiple letters defining a multi-letter code, each of the multiple letters providing an indication of the relevance of the NOTAM subject code to an airport during a corresponding phase of flight of the planned flight route, determining the target phase of flight from the plurality of predetermined phases of flight associated with the aircraft, retrieving the relevance code for each of a plurality of NOTAM subject codes for each of the plurality of predetermined phases of flight, determining a relevance for each of the plurality of NOTAMs according to the relevance code associated with the NOTAM subject code during the target phase of flight, and providing a notification of one or more of the plurality of NOTAMs according to the relevance for the target phase of flight.

9. The NOTAM notification computer system of claim 8, wherein determining the relevance for each of the plurality of NOTAMs according to the plurality of relevance rules and the target phase of flight further comprises retrieving the relevance code corresponding to the target phase of flight, and wherein providing the notification of one or more NOTAMs according to the relevance for the target phase of flight further comprises determining one or more types of notifications to provide according to each relevance code and providing the one or more types of notifications.

10. The NOTAM notification computer system of claim 8, wherein the relevance code further comprises a four-letter code such that a first letter is associated with a departure airport or departure segment of flight, a second letter is associated with an alternative en route airport or en route segment of flight, a third letter is associated with an alternative destination airport, and a fourth letter is associated with a destination airport or arrival segment of flight.

11. The NOTAM notification computer system of claim 8, wherein the NOTAM notification application, when executed by the NOTAM notification processor, further causes the NOTAM notification computer system to provide relevant NOTAMs to the crew of an aircraft according to the target phase of flight by determining a NOTAM status for each of the plurality of NOTAMs;

determining a notification activation code for each NOTAM status; and modifying the relevance code according to the notification activation code.

12. The NOTAM notification computer system of claim 11, wherein the notification activation code further comprises an indicator that the corresponding NOTAM is effective or an indicator that the corresponding NOTAM is not effective, wherein if the notification activation code comprises the indicator that the corresponding NOTAM is not effective, then the relevance code is modified to downgrade the relevance prior to determining the one or more types of notifications to provide.

13. The NOTAM notification computer system of claim 8, wherein the target phase of flight further comprises a current phase of flight, wherein the NOTAM notification processor and memory are installed within the aircraft, and wherein determining the current phase of flight associated with the aircraft comprises retrieving real-time aircraft data collected from one or more aircraft sensors and utilizing the real-time aircraft data to determine the current phase of flight from a plurality of predefined phases of flight.

14. A non-transitory computer-readable storage medium having computer-executable instructions stored thereupon which, when executed by a computer, cause the computer to:

receive NOTAMs;

determine a target phase of flight from a plurality of predetermined phases of flight associated with an aircraft;

determining a plurality of relevance codes based on a subject of each of the NOTAMs, each phase of flight assigned corresponding relevance codes for each one of the NOTAMs including at least preflight, takeoff, departure, en route, descent, approach and landing phases of flight of a planned flight route of the aircraft, wherein each relevance code comprises multiple relevance indicators, each relevance indicator indicating the relevance of a subject of one of the NOTAMs corresponding to an airport associated with each of the plurality of predetermined phases of flight of the planned flight route, the multiple relevance indictors comprise multiple letters defining a multi-letter code, each of the multiple letters providing an indication of the relevance the subject of one of the NOTAMs corresponding to the airport during a corresponding phase of flight of the planned flight route;

determine the relevance for one of the NOTAMs according to the corresponding relevance code associated with the NOTAM during the target phase of flight;

determine whether a status of the NOTAM remains effective or is no longer effective;

if no longer effective, determine an updated relevance according to the status of the NOTAM;

determine a notification method according to the updated relevance; and provide a notification of the NOTAM according to the notification method.

15. The non-transitory computer-readable storage medium of claim 14, wherein the target phase of flight further comprises a current phase of flight, and wherein causing the computer to determine the current phase of flight associated with the aircraft comprises causing the computer to retrieve real-time aircraft data collected from one or more aircraft sensors and utilize the real-time aircraft data to determine the current phase of flight from a plurality of predefined phases of flight.

16. The non-transitory computer-readable storage medium of claim 14, wherein causing the computer to determine the relevance for the NOTAM according to the subject of the NOTAM and according to the target phase of flight further comprises causing the computer to retrieve a relevance code corresponding to the subject of the NOTAM and the target phase of flight from a set of stored relevance rules and to utilize the relevance code to determine a relevance associated with the NOTAM with respect to one or more flight segments of a planned flight route during the target phase of flight.

17. The non-transitory computer-readable storage medium of claim 16, wherein causing the computer to determine the updated relevance according to the status of the NOTAM further comprises causing the computer to identify a notification activation code associated with the status of the NOTAM and to maintain the relevance of the NOTAM if the notification activation code indicates that the NOTAM is effective and to downgrade the relevance of the NOTAM if the notification activation code indicates that the NOTAM is no longer effective.

* * * * *